United States Patent [19]

Voltmer et al.

[11] Patent Number: 4,602,977

[45] Date of Patent: Jul. 29, 1986

[54] COMBINATION LABELING AND LITERATURE APPLYING MACHINE

[75] Inventors: Helmut Voltmer, Park Ridge; Alfred F. Schwenzer, Totowa, both of N.J.

[73] Assignee: New Jersey Machine, Inc., Fairfield, N.J.

[21] Appl. No.: 656,979

[22] Filed: Oct. 2, 1984

[51] Int. Cl.[4] ..... B65C 3/16; B65C 9/14

[52] U.S. Cl. ..... 156/449; 156/497; 156/521; 156/560; 156/568; 156/571; 156/DIG. 13; 156/DIG. 26; 156/DIG. 31; 156/DIG. 33; 271/276

[58] Field of Search ..... 156/521, 560, 568, 571, 156/449, 497, DIG. 13, DIG. 26, DIG. 31, DIG. 33; 271/276, 315

[56] References Cited

U.S. PATENT DOCUMENTS

| | | | |
|---|---|---|---|
| 2,107,311 | 2/1938 | Strickler | 156/521 |
| 2,543,220 | 2/1951 | Ardell | 156/521 |
| 3,536,560 | 10/1970 | Della Vita et al. | 156/560 |
| 3,864,187 | 2/1975 | Carter | 156/568 |
| 4,309,237 | 1/1982 | Lemke et al. | 156/521 |

*Primary Examiner*—Michael Wityshyn

*Attorney, Agent, or Firm*—Charles E. Baxley

[57] ABSTRACT

A banding and labeling system for containers includes a central drum which is heated for activation of adhesive coating provided on bands and labels which are to be secured to containers. The drum is provided with carrying elements employing suction, referred to as mouthpieces, which include pockets for holding literature and support bands in appropriate positions for securing the literature to containers. Dispensers are mounted peripherally around the drum at successive work stations for transference of banding materials, labeling materials, and literature packets to the mouthpieces as the drum rotates. At a final work station, a conveyor transports the containers to the drum whereupon the banding and labeling materials are secured to the containers during rotation of the containers between the drum and pressure pads which engage the adhesive coatings to the outer surfaces of the containers. Vacuum valves are provided for initiating and for terminating suction via sets of suction holes to various portions of each of the elements which are to be mounted on the containers. The initiation and termination of vacuum permits the transference of the foregoing elements from the dispensers to the drum and from the drum to the containers.

11 Claims, 17 Drawing Figures

COMBINATION LABELING AND LITERATURE APPLYING MACHINE

BACKGROUND OF THE INVENTION

This invention relates to packaging equipment and, more particularly, to a system for applying labels and literature, such as folded matter, to the outside of primarily round containers. The literature may be secured by the label or by a separate adhesive band to the container.

The majority of containers used in the market place to store and distribute food, drugs, food supplements and other such items have a substantially round cross section and are generally closed by means of a closure, such as a screw cap, upon it. Information as to the contents of the container is generally provided by the use of a label adhered to the circumferential surface of the container. When still further information about the product is required, such further information is provided by a folded literature packet, sometimes referred to as an outsert which is secured to the container.

A problem exists in that the securing of the literature to the container may not be accomplished as readily and expeditiously as is desirable in packaging facilities employing automated equipment for the filling and the closure of containers. These automated packaging lines generally include a labeling machine for decorating the containers and identifying the contents. The application of the outsert to the container often requires an additional piece of equipment which increases the required floor space of the packaging line. Alternatively, the literature may be affixed to the container manually, as by a rubber band, this decreasing the efficiency of the packaging line. It is most desirable that the securing of the literature to the container be accomplished at a rate commensurate with the other steps in the packaging operation and at no increase in the physical length of the packaging line.

SUMMARY OF THE INVENTION

The foregoing problem is overcome and other advantages are provided by a system which incorporates the invention to combine the labeling and the literature applying functions. The literature is secured either by use of a label or an adhesive band. The system includes means for applying a primary label, for cutting adhesive bands from a supply roll of the bands, for lifting a piece of literature from a supply of the literature, for applying the adhesive band to the literature, and for then securing the band and the literature to the container. The primary lables may be supplied from a hopper or from a continuous web. The preferred embodiment of the invention utilizes thermosensitive material for both the label and the band and, accordingly, employs means for heating the material to activate the adhesive.

A feature of the invention is the use of a heated drum located adjacent a conveyor of the containers and having the supplies of labels, bands and literature disposed about the peripheral surface of the drum so as to allow the drum to pick up and carry the labels, bands and literature packets from the supplies to the containers while simultaneously applying heat to the labels and the bands to activate their adhesive coatings.

A further feature of the invention is the construction of the drum as an assembly incorporating vacuum passages whereby suction can be applied to the labels, bands and literature packets to hold them on the peripheral surface of the drum. The drum is slidably and rotatably supported alongside a stationary valve plate having orifices for initiating and terminating suction as the drum rotates along the valve plate, thereby to lift and to release the labels, bands and packets at the desired locations in the operation of the system.

In addition, detachable segments, referred to as mouthpieces, are provided with vacuum passages and are positioned along the peripheral surface of the drum for carrying the labels, bands and packets. The vacuum passages of the mouthpieces connect with the vacuum passages of the drum for communication of the suction to the labels, bands and packets. The outer surface of a mouthpiece is provided with a pocket configured for carrying a packet and other regions for carrying a label and a band. The mouthpieces are interchangeable, the arrangement of the foregoing pocket and regions conforming to the layout of the label, the band and the literature packet on the surface of the container.

BRIEF DESCRIPTION OF THE DRAWINGS

The foregoing aspects and other features of the invention are explained in the following description taken in connection with the accompanying drawings wherein.

DETAILED DESCRIPTION

Figure 1:
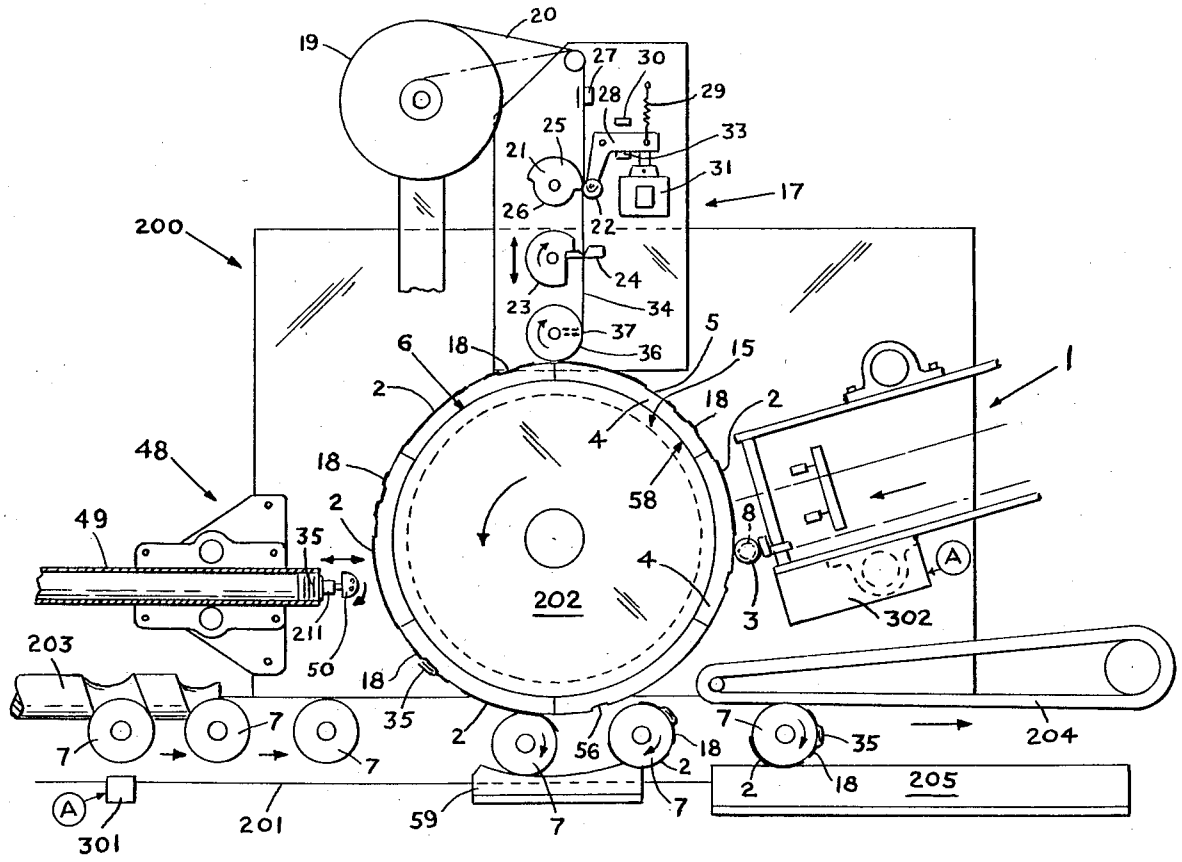
FIG. 1 is a top plan view of the labeling and literature banding system incorporating the invention, the view including the heated label drum, a simplified view of a label dispensing mechanism, a band dispensing mechanism, and a simplified view of a literature dispensing mechanism.

With reference to FIGS. 1–8, there is shown a labeling and literature dispensing and banding system 200 incorporating the invention for securing labels and literature to the sides of containers 7 by means of thermosensitive adhesive. The literature is arranged as a packet 35 which is secured to a container 7 by either a band or label coated with a thermosensitive adhesive. The system 200 is utilized in conjunction with a conveyor 201 of the containers 7 and includes a rotatable heated drum 202 disposed alongside the conveyor 201 for applying the labels and the literature to the container 7. The novel features of the invention may be better understood with reference to the specific details of the construction of the system 200 as is now presented.

The system 200 comprises a known label supply system 1 (such as a system manufactured by New Jersey Machine Inc., Fairfield, N.J.) to provide a primary label 2 via an intermittently rotating label transfer drum 3 to the label-applying drum 202. An outer peripheral portion 15 of the drum 202 incorporates a plurality of detachable and interchangeable segments, to be referred to as mouthpieces 4 for carrying labels, literature and bands. A set of six of the mouthpieces are provided by way of example in the embodiment of the applying drum 202 shown in FIG. 1. A primary label 2 is securely held to th outer surface 5 of a mouthpiece 4 by means of vacuum supplied by a known source via suction holes in the outer surface 5 of the mouthpiece 4, there being a set of the suction holes distributed about the surface 5 to engage the entire surface of the primary label 2. Timing of the vacuum action (on-off) is regulated by a stationary vacuum timing valve plate 6 (FIG. 6) which is interposed between the source of vacuum and the applying drum 202. A well-known sensor 301, such as a photoelectric sensor, is responsive to the presence of a container 7 on the conveyor 201 for triggering a mechanism 302 of the supply system 1 to dispense a label for the container 7.

The operation of the banding system 200 follows a sequence of steps which is readily described with reference to FIG. 1. Upon the approach of a container 7 to the applying drum 202, a primary label 2 is dispensed by the supply system 1 to a mouthpiece 4 as the mouthpiece 4 is carried by the drum 202 past the exit port of the supply system 1. The valve plate 6 administers suction via passages (to be explained with reference to FIGS. 9–10) in the drum 202 to the mouthpiece 4 for lifting the label 2 away from the transfer drum 3 and holding the label against suction holes 208 in the face of the mouthpiece 4. The mouthpiece 4 continues to travel and passes a band dispensing system 17 wherein a further application of suction secures a band to the mouthpiece 4. Still further travel of the mouthpiece 4 brings it to a literature dispensing mechanism 48 wherein a further application of suction secures a literature packet 35 to the mouthpiece 4. The applying drum 202 is heated by conventional means (not shown), and the heat of the drum 202 permeates the adhesive coating of the label and the band so as to activate the coating. Upon still further rotation of the applying drum 202, the mouthpiece 4 approaches the container 7 whereupon the vacuum is released by the valve plate 6 and the adhesive coating contacts the outer surface of the container 7 for lifting the label, band and literature away from the mouthpiece and securing the label, band and literature to the container 7.

Figures 6, 8:
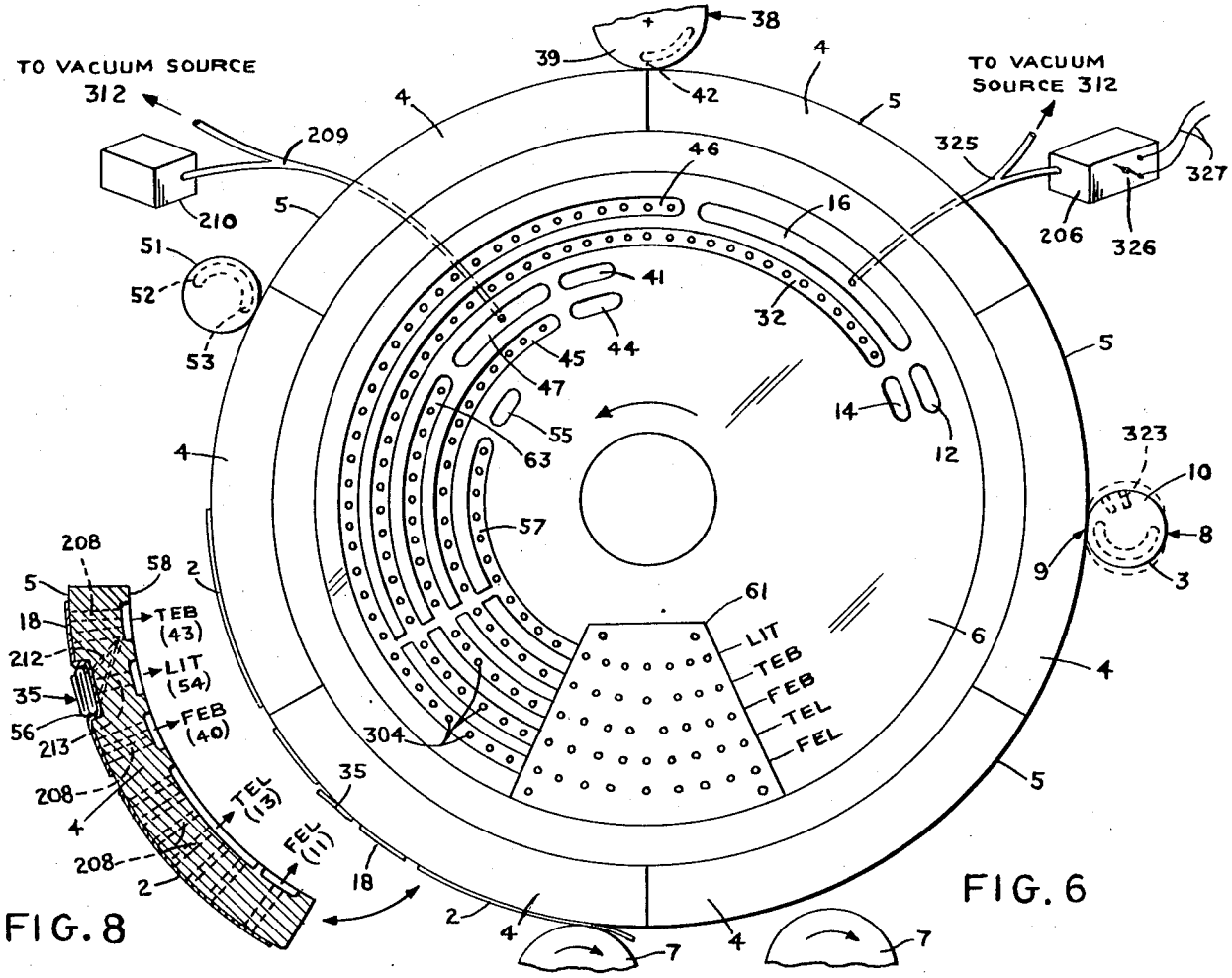
FIG. 6 is a top plan view of a valve plate constructed as a stationary vacuum ring disposed above the drum of FIG. 1 for controlling a sequence of operations in lifting and releasing the label, the band and the packet by the mouthpieces of either FIGS. 2 or 4.
FIG. 8 is a cross sectional view of the lower left mouthpiece carrying a literature packet disclosed in FIG. 6.
Figure 7A:
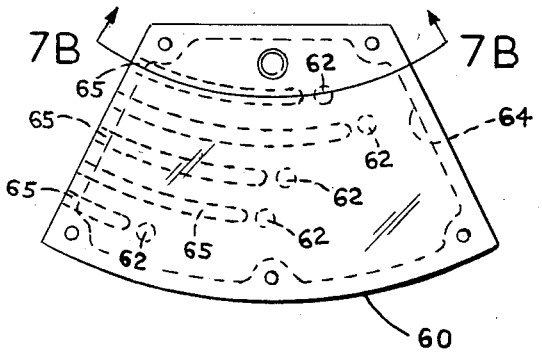
FIGS. 7A–C show, respectively, top, sectional and bottom views of an insert for the vacuum ring of FIG. 6, the vacuum ring and the insert coacting as the valve plate for the drum of FIG. 1, the insert being selected for adjusting the suction in accordance with the physical sizes of the label and the band.
Figure 7B:
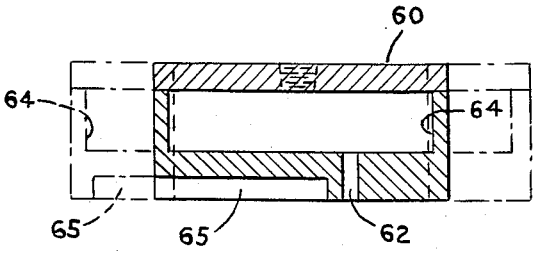
Figure 7C:
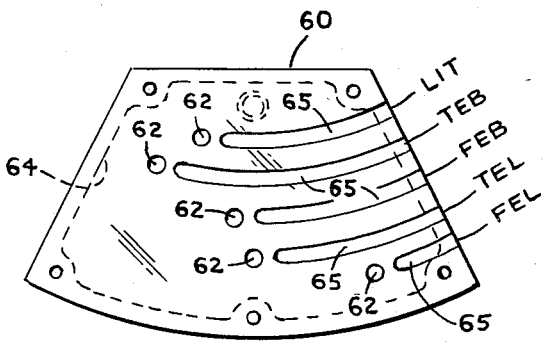
Figure 9A:
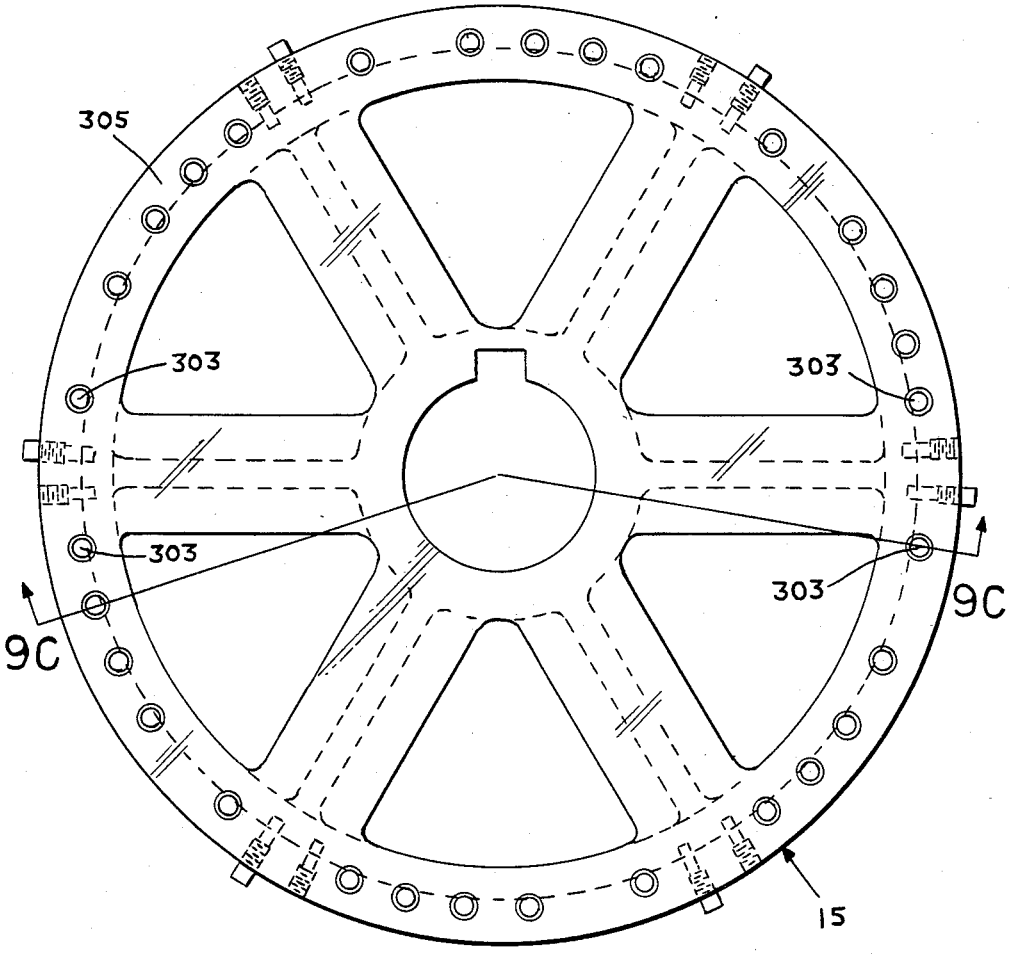
FIGS. 9A–C show respectively a top plan view, a right side view and an axial sectional view of a wheel portion of the drum of FIG. 1, disclosing suction passages extending sideways, in the direction of the drum axis, beneath the label and band carrying regions and connecting therewith, and wherein the view of FIG. 9C is taken along the line 9C—9C in FIG. 9A.
Figure 9B:
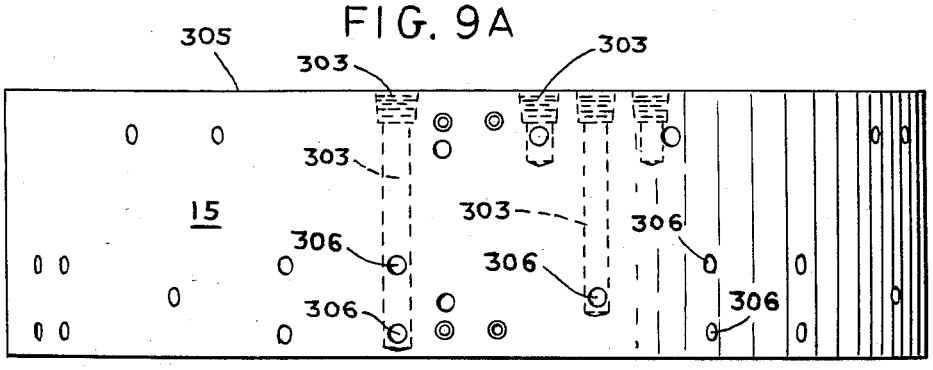
Figure 9C:
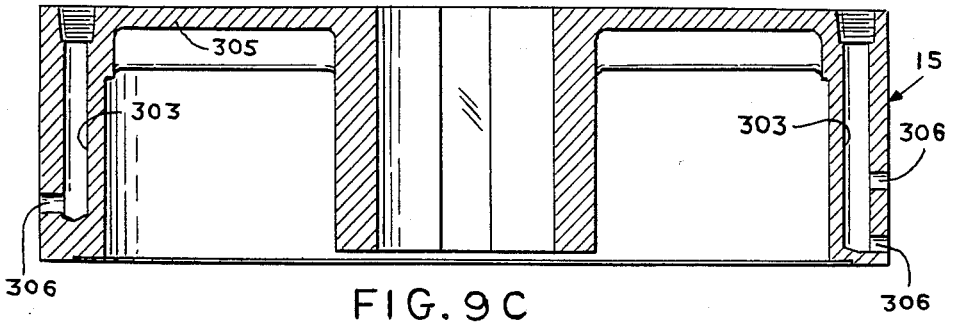
Figure 10A:
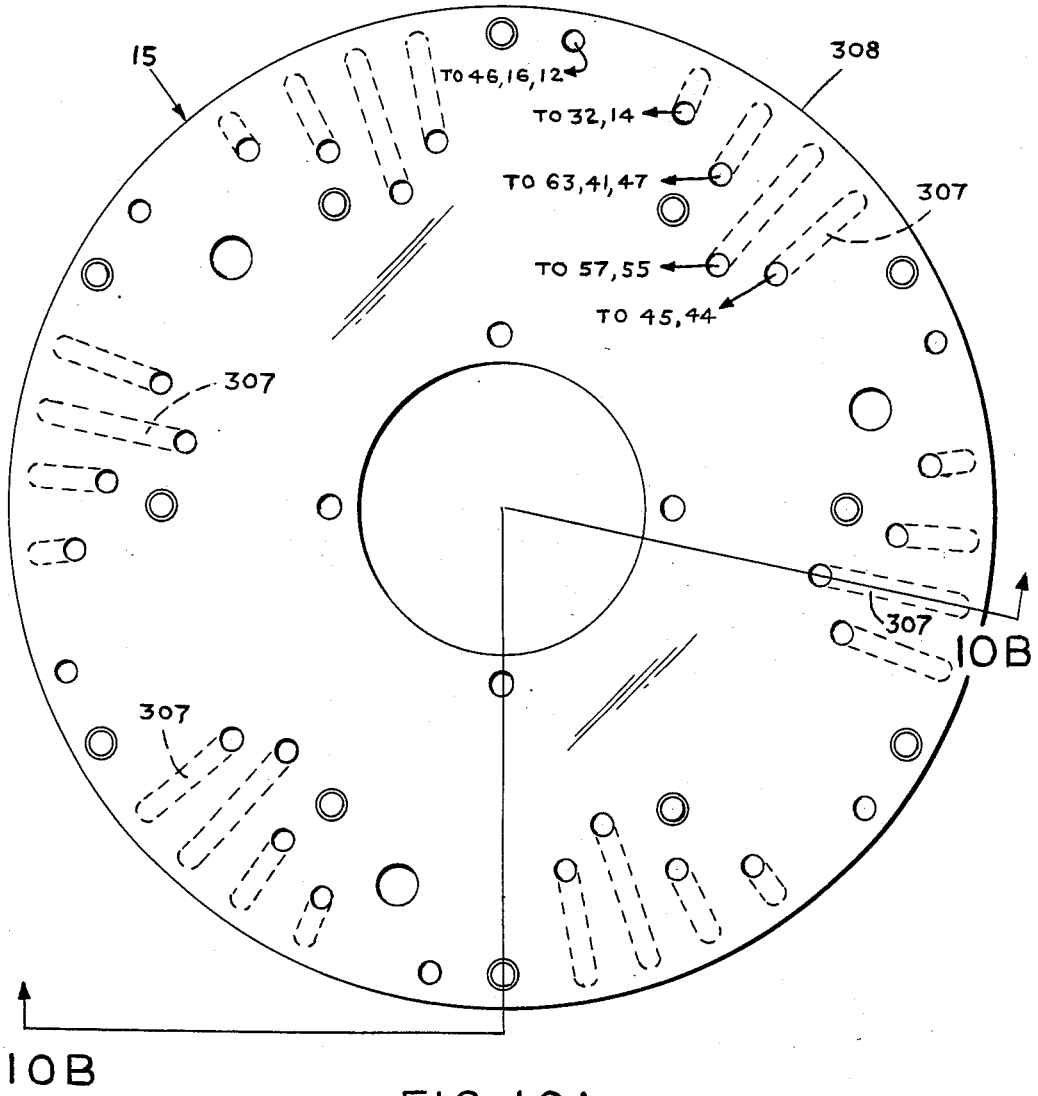
FIGS. 10A–B are top plan and side (partially sectioned) views of a vacuum chamber ring portion of the drum having radially directed vacuum passages of differing lengths for connecting specific ones of the axial passages of FIG. 9 with individual sector vacuum passages of the valve plate of FIG. 6.
Figure 10B:
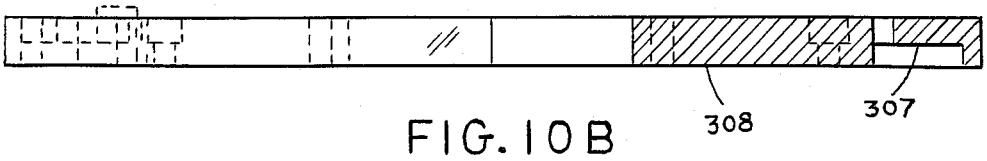
Figure 11A:
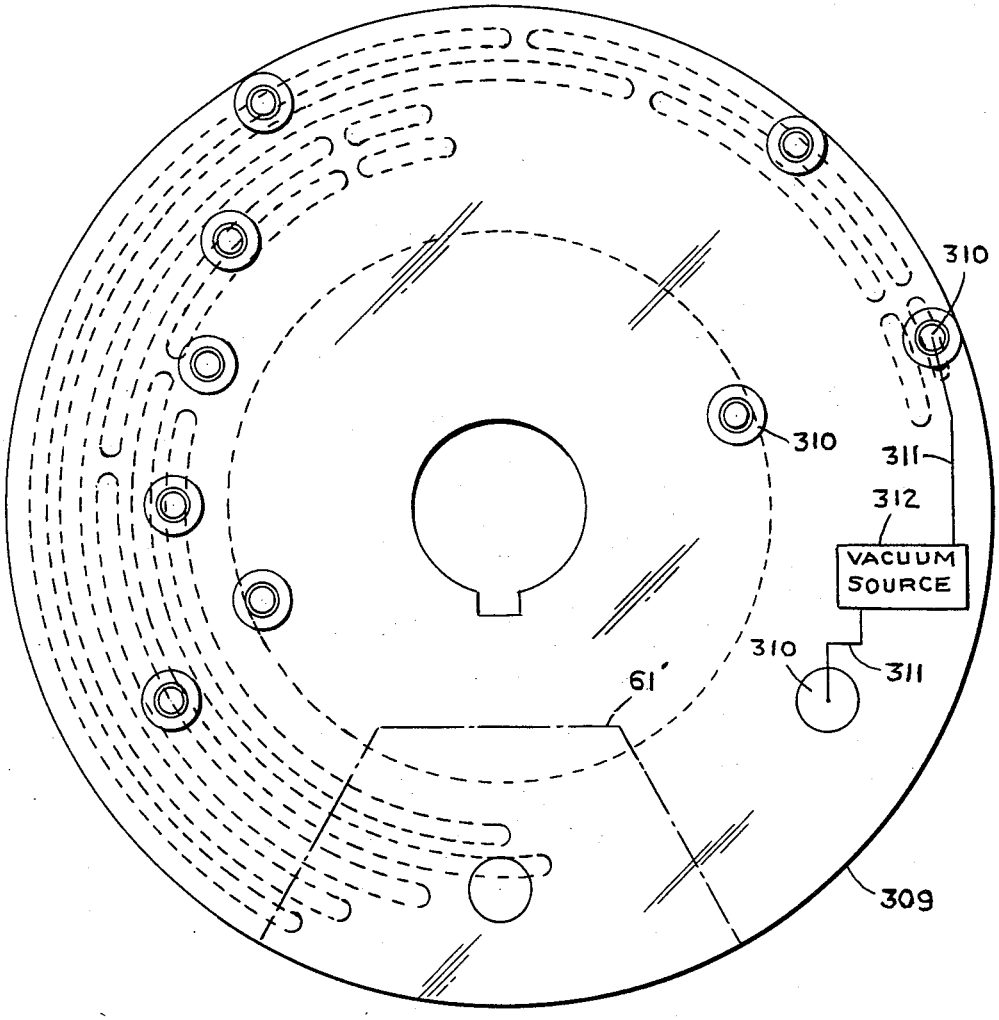
FIGS. 11A–B are plan and side views of a vacuum supply porting the plate which sits above adjacent the ring of FIGS. 10A–B and on top of the valve plate of FIG. 6, closes off the sector vacuum passages of the valve plate, and incorporates ports for the connection of an external source of vacuum to the vacuum passages.
Figure 11B:
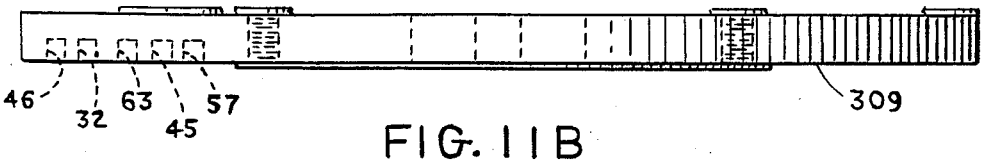

FIGS. 9–11 present details in the constructions of the applying drum 202 and the valve plate 6 associated therewith. FIGS. 9A–C show a plan view, a fragmentary elevation view, and a sectional view along the drum axis of the portion of the drum 202 which carries the mouthpieces 4, the mouthpieces being deleted in the figures to better disclose suction passages 303 which lay beneath the mounting surface 15 in a wheel portion 305 of the drum 202, upon which surface 15 set the mouthpieces 4. The passages 303 apply vacuum to suction holes 306, which suction holes couple with the suction holes 208 of the mouthpieces 4. The passages 303 extend parallel to the axis of the drum 202 to exit the wheel portion 305 and to couple with radially extending vacuum passages 307 of a ring portion 308 (FIGS. 10A–B) of the drum 202. The ring portion 308 of the drum 202 provides vacuum connection between the passages 303 of the wheel portion 305 and arcuate carrying ports 46, 32, 63, 45 and 57, as well as ports 12, 14, 16, 41, 44, 47 and 55 of the valve plate 6 (FIG. 6). Each of the carrying ports 46, 32, 63, 45 and 57 is formed as an apertured channel wherein the channel communicates vacuum among a set of apertures which serve for the coupling of vacuum to the mouthpieces 4. The ring portion 308 and the wheel portion 305 rotate together as an integral assembly. The radial passages 307 are of differing lengths, the inner ends of the passages 307 terminating at respective ones of the channels of the carrying ports 46, 32, 63, 45 and 57 thereby permitting individual ones of the carrying ports 46, 32, 63, 45 and 57 to selectively control specific groups of the suction holes 208 in a mouthpiece 4. The top portions of the carrying ports 46, 32, 63, 45 and 57 are closed off by a vacuum supply plate 309 (FIGS. 11A–B), the supply plate 309 being set on top of and forming an integral assembly with the valve plate 6. The supply plate 309 also incorporates ports 310 by which vacuum hoses 311 (indicated schematically) connect the valve plate 6 with a source of vacuum 312.

The construction of valve plates and their connection with drums having suction ports therein is well-known, the foregoing description being provided to show the specific structural arrangement employed in a preferred embodiment of the invention. In particular, it is noted that the plurality of concentric carrying ports 46, 32, 63, 45 and 57 and the coupling thereto of the radial passages 307 of differing lengths provide for simultaneous and independent control of the suction applied to the front edge of a label (FEL) and the tail end of a label (TEL) for precise acquisition and release of a label, band, and literature packet. Use of the insert 60 (FIGS. 7A–C) provides for elongation of the carrying ports 46, 32, 63, 45 and 57 into respective ones of a set of supply channels 65 in the insert 60 so as to adjust the spatial distribution of active suction holes 208 in a mouthpiece 4 to accommodate labels and bands of differing lengths. The insert 60 sets within the cavity 61 (FIG. 6) and within the cavity 61' (FIG. 11A).

Further details in the operation and in the components of the banding system 200 are now described with reference to the FIGS. 1–8. With respect to the supplying of labels 2 from the supply system 1 to the applying drum 202, the label transfer drum 3 rotates the primary label 2 from the receiving position at 8 (indicated at the plate of the vacuum valve 10 of the drum 3 in FIG. 6) to release position 9 of the transfer drum 3 (similiarly indicated in FIG. 6). The label 2 is held on the transfer drum 3 during this transition by means of vacuum from a known source, such as the source 312, controlled by the vacuum valve 10. The vacuum valve 10 is stationary and is located beneath the rotating transfer drum 3. As the front suction holes 323 (FIG. 6) of the label transfer drum 3 reach the release position 9 of the vacuum valve 10, the FEL port 11 of the mouthpiece 4 reaches the pick-up port 12 of the circular row of vacuum ports 304 (FIG. 6) in the FEL row of the timing valve plate 6. The resulting actuation of the vacuum transfers the front edge of the primary label 2 from the transfer drum 3 to the mouthpiece 4. As the applying drum 202 continues to rotate beneath the stationary valve plate 6 with the same peripheral speed as the peripheral speed of the transfer drum 3, further portions of the label 2 are transferred to the mouthpiece 4 and are held in place by suction. The suction is applied via the holes 208 associated with the TEL port 13 (FIG. 8) of the mouthpiece 4, with control of the vacuum being provided by the pick-up port 14 (FIG. 6) of the circular row of vacuum ports 304 at the TEL row of the vacuum timing valve plate 6. The ports 304 are located in the carrying ports 32, 46, 45, 57 and 63 and function as orifices to prevent loss of vacuum when a mouthpiece 4 carries no label.

With further rotation of the applying drum 202 beneath the valve plate 6, the FEL port 11 (FIG. 8) of the mouthpiece 4 reaches the label sensing port 16 (FIG. 6) of the valve plate 6, and the TEL port 13 of the mouthpiece 4 reaches a carrying port 32 (FIG. 6) of the TEL row of ports 304 of the valve plate 6. The label sensing port 16 is connected to a source of vacuum through an orifice 325 (indicated diagrammatically in FIG. 6) which is smaller in area than the combined areas of the vacuum holes 208 (FIGS. 2 and 8) connecting the FEL port 11 of the mouthpiece 4 to its outer surface 5. A vacuum actuated switch 206 is indicated diagrammatically in FIG. 6, such a switch being manufactured by the Barksdale Company. The switch 206 is situated between the orifice 325 and the outer surface 5 of the mouthpiece 4. The switch 206 includes electrical contacts 326 which close the circuit of electric wires 327 upon actuation of the switch 206 by the application of the vacuum to the switch 206. The presence of the label 2 covering the foregoing suction holes 208 creates a vacuum in the port 16 resulting in a closing of the contacts 326 of the switch 206 and a transmission of an electric signal to the band dispensing system 17 to initiate operation for the dispensing of a band 18 to the applying drum 202.

The band dispensing system 17 comprises a supply roll 19 of a band 20 having a thermally sensitive adhesive layer. The band 20 is drawn from the roll 19 by the combined action of a feed roll 21 and a pressure roll 22 which is spring-loaded for contacting the feed roll 21. Pressure of the roll 22 against th roll 21 provides for secure frictional contact between the band 20 and the roll 21 for accurate drawing of the band 20 by the roll 21. A portion of the band 20 which is fed by the roll 21 is then passed onto a rotary knife 23 and a mating cutting edge 24 which cuts off a predetermined length of the band. The operation of the knife 23 is synchronized with the operation of the roll 21 so as to provide for the cutting of the band at the appropriate instants of time corresponding to the desired lengths of band. The mechanism for the operation of a rotary knife 23 with its mating cutting edge 24, as well as devices for the synchronization of such mechanisms with the rotation of feed rolls, are well-known and have been deleted from the figures so as to facilitate the portrayal of the essential elements of the system 200.

In the construction of the feed roll 21, the outer peripheral surface is structured of two portions 25 and 26, the portion 25 having an extended radius while the portion 26 has a reduced radius. Thereby, the portion 25 makes contact with the pressure roll 22 while the portion 26 is sufficiently retracted so as to avoid contact with the roll 22. The roll 22 is carried by an arm 28 which is pivotally mounted between two stops 30 and 33 which limit the amount of pivoting. An end of the arm 28 opposite the roll 22 connects with a spring 29 and an electrically operated solenoid 31 which induce, respectively, a counterclockwise rotation against the stop 30 and a clockwise rotation against the stop 33. The portion 26 of the peripheral surface of the feed roll 21 is retracted sufficiently such that there is no contact with the pressure roll 22 even when the arm 28 is in the extreme position against the stop 33.

Accordingly, there is a drawing of the band 20 by the feed roll 21 only during the interval of time associated with the contact between the peripheral surface portion 25 and the roll 22, there being no drawing of the band 20 during the duration of time when the peripheral surface portion 26 is facing the pressure roll 22. The dispensing system 17 includes a drag pad 27 which contacts the band 20 so as to provide a retarding frictional force against which force the feed roll 21 must pull. The retarding force of the drag pad 27 insures that movement of the band 20 stops during the interval of time when the surface portion 26 is facing the pressure roll 22. The force of the spring 29 tends to bias the arm 28 against the stop 30 for separating the rolls 21 and 22, thereby preventing the forward motion of the band 20. However, when the presence of a label 2 on the mouthpiece 4 creates a vacuum in the sensing port 16 (FIG. 6), the resulting closure of the contacts 326 of the vacuum operated switch 206 energizes the solenoid 31 via the wires 327. The energization of the solenoid 31 overcomes the force of the spring 29 and urges the arm 28 into the operating position against the stop 33.

Figure 3:
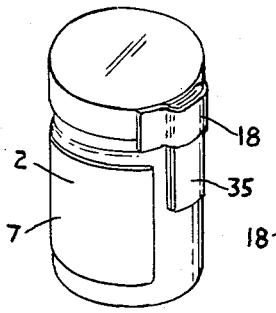
FIG. 3 shows the location of the label and the literature packet secured by the band on a typical container, the label and the band adhering to the surface of the container by a thermosensitive adhesive.

The portion 34 of the band 20 (FIG. 1) which is cut off by the rotating knife 23 protrudes beyond the knife 23 and becomes an encompassing band 18 for attachment of a literature packet 35 to the container 7 as portrayed in FIG. 3. The band portion 34 is transferred from its cut-off position by the band transfer roll 36 which rotates in synchronism with the movement of the mouthpiece 4. The synchronous rotation of all of the rotating elements, the feed roll 21, the rotating knife 23, and the band transfer roll 36 is achieved via well-known means, not shown in the drawing. The peripheral speeds of the rotating elements described above are equal to the peripheral speed of the outer surface 5 of the mouthpieces 4. During the acquisition of the band portion 34 by the mouthpiece 4, the front edge of the band portion 34 is held by vacuum to the band transfer roll 36. The foregoing vacuum in the transfer roll 36 is actuated when suction holes 37 in the transfer roll 36 are located in the pick-up position 38 (FIG. 6) of the vacuum valve 39, the vacuum valve 39 being located beneath the transfer roll 36 and communicating therewith for controlling the vacuum thereof.

Upon further rotation of the applying drum 202, the port 40 (FIG. 8) of the mouthpiece 4 associated with the front edge of the band (FEB) reaches the pick-up port 41 (FIG. 6) of the circular row of vacuum porting holes (FEB row) of the valve plate 6. At the same time, the suction holes 37 in the transfer roll 36 reach the transfer position 42 (FIG. 6) of the transfer-roll vacuum valve 39. Thereupon, the band portion 34 is transferred from the transfer roll 36 to the mouthpiece segment 4 to become the encompassing band 18. The front edge of the band 18 is held in contact with the outer surface 5 of the mouthpiece 4 by a vacuum supplied through the suction holes 208 connecting the FEB port 40 of the mouthpiece 4 to the outer surface 5. With still further rotation of the applying drum 202 beneath the vacuum valve plate 6, the drum 202 progressively accepts further portions of the band 18 into contact with the outer surface 5 of the mouthpiece 4. These further portions of the band 18 are held in contact with the outer surface 5 by the vacuum present in the suction holes 208 connecting the tail end of band (TEB) port 43 of the mouthpiece 4 to the outer surface 5. The vacuum is supplied to the TEB port 43 from the valve plate 6 by way of the pick-up port 44 of the circular row of ports 304 (TEB row). Thereafter, the vacuum is supplied from the carrying ports 45 of the same row of the valve plate 6. During the foregoing rotation of the drum 202 the FEL port 11 of the mouthpiece 4 associated with the next label 2 has advanced in position. The FEL port 11 has moved from the location wherein it received its vacuum from the label sensing port 16 of the FEL row of the valve plate 6 to the carrying port 46 of the same row. The carrying ports 45, 46 now supply vacuum through the ports 304.

With still further rotation of the applying drum 202 the FEB port 40 of the mouthpiece 4 becomes coupled via the vacuum passages to the band sensing port 47 of the valve plate 6. Following an operational procedure similar to that described above for the label sensing port 16, the band sensing port 47 is connected to the source of vacuum through an orifice 209 (indicated diagrammatically in FIG. 6) which is smaller in area than the combined areas of the vacuum holes 208 connecting the FEB port 40 to the outer surface 5 of the mouthpiece 4. A second vacuum switch 210 (of the same construction as the switch 206) is situated between the orifice 209 and the outer surface 5 of the mouthpiece 4. The presence of an encompassing band 18 covering the suction holes 208 creates a vacuum in the port 47, thereby actuating the switch 210 to those electrical contacts for generating an electric signal which activates the literature dispensing mechanism 48 (FIG. 1). Upon further rotation of the drum 202, the FEB port 40 becomes coupled to the FEB carrying port 63 of the valve plate 6.

The literature dispensing mechanism 48 comprises a literature hopper 49 and a transfer roller 50 for carrying literature packets 35 from the hopper 49 to a mouthpiece 4. In operation, the signal from the vacuum switch 210 activates the literature transfer roller 50 to extract the terminal literature packet 35 from the hopper 49 by means of suction cups 211 disposed on the transfer roller 50. The vacuum is channeled to the suction cups 211 via a stationary timing vacuum valve 51, the vacuum valve 51 being located beneath the transfer roller 50 and communicating therewith for controlling the vacuum thereof. The transfer roller 50 is driven in synchronism with the motion of the applying drum 202, and is driven further by an intermittent motion device (not shown) such as a well-known cyclo-index drive. The well-known intermittent motion device is further provided with a well-known lateral motion drive which positions the transfer roller in proximity with the literature hopper 49 so as to be in a suitable position to pick up a literature packet (FIG. 1). When the appropriate vacuum passage of the transfer roller 50 is located at the pick-up position 52 of the timing vacuum valve 51, the vacuum is coupled from the valve 51 to the roller 50 for applying suction at the suction cup 211 on the roller 50. As the mouthpiece 4 approaches the location for the transfer of literature from the roller 50 to the mouthpiece 4, the literature transfer position 53 of the timing valve 51 terminates suction by the roller 50 to permit transfer of the packet 35 to the mouthpiece 4. By virtue of the synchronous movement of the mouthpiece 4 and the transfer drum 35, and as the transfer roller 50 reaches the transfer position, the literature port 54 of the mouthpiece 4 becomes connected to the source of vacuum via the literature pick-up port 55 of the circular row of ports 304, namely the LIT row in the valve plate 6 of FIG. 6. Thereby, the literature packet 35 is transferred from the roller 50 to the recessed pocket 56 of the mouthpiece 4 and held therein by vacuum holes 213 (FIG. 8) extending from the literature port 54 to the surface of the pocket 56. Upon further rotation of the drum 202, the literature port 54 in the mouthpiece 4 becomes connected to the source of vacuum via the literature carrying port 57 of the LIT row of vacuum ports of the valve plate 6. Thereby, there has been a release of the literature packet 35 from the transfer roller 50 to the pocket 56 of the mouthpiece 4. The respective timing valves have terminated the suction to the transfer roller 50 and have initiated the suction to the pocket 56 so as to accomplish the foregoing release of the packet 35 and its acquisition to the pocket 56.

Figure 2:
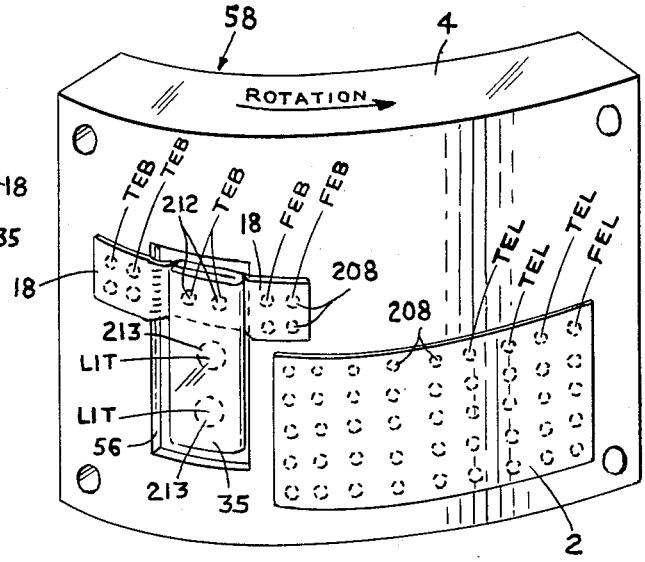
FIG. 2 is an enlarged isometric view of a mouthpiece showing the placement of a label, band and literature thereon, the mouthpiece being carried by the drum of FIG. 1.

With reference now to FIGS. 2 and 8, the details of construction of the mouthpiece 4 are more fully explained. The mouthpiece 4 is a segment of a ring of heat conducting material such as aluminum. The mouthpiece 4 has an inner arcuate surface 58 which is machined so that the surface is in airtight contact with the outer peripheral surface 15 of the heated drum 202, thereby to achieve heat transmission between the wheel portion 305 of the drum 202 and the mouthpiece 4. The mating of the foregoing two surfaces also reduces any vacuum loss to a minimum across the interface between the wheel portion 305 of the drum 202 and the mouthpiece 4. The outer surface 5 of the mouthpiece 4 carries the primary label 2 and the encompassing band with the thermo-sensitively coated surfaces of the label and band facing outwardly from the drum 202. The heat of the drum 202 renders these outwardly facing surfaces to be sticky for subsequent adherence to a container 7.

The vacuum cavities 11, 13, 40, 43, and 54 (FIG. 8) formed in the surface 58 of a mouthpiece 4 are connected through individual vacuum passages 303 and 307 (FIGS. 9 and 10) in the drum 202 to the respective vacuum porting holes arranged in the concentric rows (FEL, TEL, FEB, TEB, LIT) in the valve plate 6 of FIG. 6. Vacuum suction holes 208 drilled through the wall of the mouthpiece 4 from the outer surface 5 to the foregoing vacuum cavities are arranged in a pattern to suit the specific combination of primary label 2, encompassing band 18 and literature packet 35 as determined by the requirement of the customer and the geometry of the container 7. As shown in the example of FIG. 2, the first vertical row of suction holes 208 under the primary label 2 are connected to the FEL port 11 (FIG. 8), the remaining vertical rows under the primary label being connected to the TEL port 13 of the mouthpiece 4.

During the operation of applying the primary label 2, the encompassing band 18, and the literature packet 35 to the container 7, the container 7 rolls (as will be described subsequently) along the outer surface 5 of the mouthpiece 4, and is forced into contact with the surface of a curved pressure pad 59 (FIG. 1). Therefore, the outer surface 5 carrying the primary label 2 with the encompassing band 18 and the packet 35 together must form a smooth circular applying surface to facilitate the rolling of the container 7 along the surfaces of the pad 59 and the drum 202. The smooth outer surface of the mouthpiece 4 is attained by elimination of a protrusion of the literature packet 35 beyond the outer surface 5, this being accomplished by providing for a recessing of a literature pocket 56 into the outer surface 5. The size (width and height) of the pocket 56 is slightly larger in dimension than the packet 35. The position of the pocket 56 in the mouthpiece 4 is determined by the position of the literature packet 35 on the container 7. The depth of the pocket 56 is recessed by an amount corresponding to the depth of the packet so that the outer surface of the literature packet 35 and the outer surface 5 of the mouthpiece 4 blend into a continuous smooth circular surface.

The leading edge of the encompassing band 18 is held to the outer surface 5 of the mouthpiece 4 by suction holes 208 connected to the FEB port 40 (FIG. 8). The trailing portion of the encompassing band 18 is first deposited into the bottom of a cavity 56, and held there by suction holes 212 connected to the TEB port 43 and the balance of the trailing portion surfaces at the bottom of the cavity. The end portions of the band 18 are held against the outer surface 5 of the mouthpiece 4 by additional suction holes 208 connected to the TEB port 43 (FIGS. 2 and 8). Thus, the packet 35 is placed in the pocket 56 over the underlying portion of the band 18 and held in place by suction holes 213 connected to the LIT port 54 (FIG. 8).

Upon further rotation of the drum 202 carrying the primary label 2, the band 18, and the packet 35 on the outer surface 5 of a mouthpiece 4, the mouthpiece 4 approaches the next work station. At this station, the container 7 sets upon the conveyer 201 for receiving the primary label 2. The movements of the conveyer 201 and the drum 202 result in a capturing of the container 7 between the outer surface 5 of the mouthpiece 4 and the stationary curved pressure pad 59. The frictional contact between the container 7 and the drum 202 along with the pad 59 induces rotation of the container 7. As the mouthpiece 4 continues its advance, the front edge of the primary label 2 is adhered to the rotating container 7 and, simultaneously, the vacuum holding the front edge of the label 2 is cut off by the terminus of the FEL supply channel 65 of the timing insert 60 (FIG. 7). The insert 60 is configured to fit airtight into the aforementioned corresponding cavity 61 of the valve plate 6 and cavity 61' in the vacuum supply plate 309 to provide secure passages for the vacuum.

Breather holes 62 are located adjacent the ends of the respective arcuate supply channels 65 (namely, FEL, TEL, FEB, TEB, LIT) in the insert 60 which are extensions of the respective carrying ports 32, 45, 46, 57, 63 of the corresponding circular rows in the valve plate 6. The breather holes 62 are either connected to a compressed air supply from a known source via an air manifold 64 in the insert 60, or are connected to the surrounding atmosphere to hasten the depletion of the residual vacuum in the respective ports 11, 13, 40, 43, 54 to insure essentially instantaneous release of the carried medium (label, band, literature).

Continuing rotation of the applying drum 202 with its mouthpieces 4 will successively adhere the balance of the primary label 2, the front edge of the encompassing band 18, the literature packet 35, and the tail end of the encompassing band 18 onto the circumferential surface of the rotating container 7. The releasing of the holding vacuum of each corresponding vacuum port in the mouthpiece 4 is timed by the ending of the corresponding supply channel 65 in the timing insert 60 in co-operation with the action of the associated breather holes 62 as described above for the release of the front edge of the label. The finished product of the above procedure is illustrated in the labeling of the container 7 of FIG. 3.

With reference to the operation of the conveyor portions of the system 200 in co-operation with the rotation of the drum 202, it is noted that a series of the containers 7 is located on the conveyor 201 with the containers 7 being spaced apart by means of a timing worm 203. The spacing of the containers 7 is equal to the distances between successive ones of the mouthpieces 4 about the periphery of the drum 202. Additional compressive force is applied to each finished decorated container 7 by rotating the container 7 through a co-operating moving pressure belt 204 and a stationary resilient pressure pad 205.

In view of the foregoing description of the invention, it is readily appreciated that a container traveling along a conveyor can receive a label and literature which is banded securely to the outer surface of the container. In addition, the mounting of the mouthpiece segments 4 on the heated drum 202 provide for the ready transfer of labels, of sections of banding material, and of pieces of literature from their respective dispensers to be applied to the container.

Figure 5:
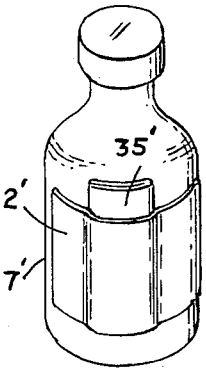
FIG. 5 shows a view of a container having a literature packet secured thereto by a label, the attachment of the label and packet being accomplished with the mouthpiece of FIG. 4.
Figure 4:
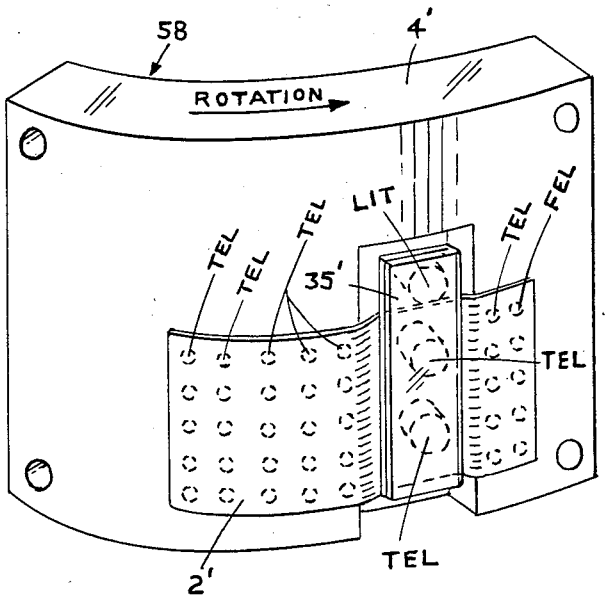
FIG. 4 is an enlarged isometric view of an alternative mouthpiece showing an alternative labeling arrangement in which the label itself is used to secure the literature packet without the use of a separate band for encompassing the literature packet and securing it to the container.

FIGS. 4 and 5 show an alternative labeling arrangement wherein a single large primary label 2' is placed within a pocket 56 in lieu of the band 18 of FIG. 2. Thereby, upon transference of the primary label 2' to the container 7, the label 2' secures a literature packet 35' to the outer surface of the container 7 as depicted in FIG. 5. Thereby, the primary label 2' serves the dual function of labeling and of securing the literature. The foregoing arrangement is readily accomplished by arranging the components of a mouthpiece 4' to accommodate the arrangement and physical sizes of the elements (the label and the literature packet) which are to be secured to the container. In addition, the passages of the valve plate 6 (FIG. 6) would be modified so as to initiate and terminate the vacuum in accordance with the positions of the front and trailing edges of the primary label 2'.

By way of further embodiments of the invention, it is to be noted that if portions of the primary label 2' (FIG. 4) or of the encompassing band 18 (FIG. 2) are thermally isolated by known means so as to be insulated from the heat of the drum 202, the isolated portions will not become activated and, hence, not be sticky. This provides a means for securing the literature without having the literature stick to the band or to the label. With this arrangement, the underlying literature can be held to the container by frictional pressure between the encompassing medium and the container only, thereby allowing the literature to be removed without the destructions of the encompassing medium.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

We claim:

1. A system for applying a label and literature to the exterior surface of a container comprising:

a drum rotatably mounted between a set of work stations, a first of said stations being a dispenser of strips of adhesive material for affixation to said container, and a second of said stations being a dispenser of literature packets, the adhesive material and the packets being applied to the container at a third of said stations;

receiving means carried by said drum past each of said work stations for receiving strips of the material and packets from said dispensers of the material and the packets, respectively, at said first and said second work stations, said receiving means employing suction for holding said material and said packets;

means for conveying the container to said drum at said third work station for transfer of the adhesive material and the packets to the container;

vacuum means synchronized with rotation of said drum for initiating and terminating suction at said receiving means, a transfer of a strip of said material and of a packet from their respective dispensers to said receiving means occurring upon initiation of suction by said suction vacuum means to said receiving means, a transfer of a strip of said material and a packet from said receiving means to a container occurring upon a termination of the suction to said receiving means by said vacuum means; and wherein said receiving means has an outer surface configured with a recessed pocket for holding one of said packets recessed from said outer surface, said strip of adhesive material extends beyond the width of said pocket, said synchronization of said vacuum means provides for the transfer of the strip of adhesive material from its dispenser to the site of the pocket prior to insertion of the packet into said pocket, said suction holding a central portion of the strip against a floor of the pocket and the ends of the strip against said outer surface of said receiving means, thereby allowing the ends of the strip of the adhesive material to contact the container for securing the literature packet to the container; and wherein said receiving means is formed of a set of mouthpieces disposed serially along the periphery of said drum, each of said mouthpieces having a set of suction holes disposed along said outer surface and arranged in correspondence with the dimensions of said strip of material and in correspondence with the position of said strip of material relative to the position of the literature packet upon said container; and wherein said vacuum means includes a valve plate operatively coupled with said drum for initiating and terminating vacuum to respective ones of said mouthpieces, and wherein said valve plate includes an insert having vacuum supply channels therein for selectively presetting the duration of suction applied to respective ones of the suction holes in each of said mouthpieces.

2. A system according to claim 1 wherein said strip of adhesive material is a label having a coating of adhesive on the back side of the label, said strip being transferred from its dispenser to said receiving means with the front surface of the label facing the outer surface of the receiving means and the back surface of the label facing away from said receiving means.

3. A system according to claim 1 wherein said set of work stations includes a fourth station, there being a dispenser of further strips of adhesive material at said fourth station, said vacuum means being operative with respect to said fourth station for the transference of the further strips of material to said receiving means for subsequent transfer to the container.

4. A system according to claim 3 wherein a strip of adhesive material from said first station is an encompassing band, and the strip of adhesive material from said fourth station is a label.

5. A system according to claim 4 wherein said label is transferred from its dispenser at said fourth station to a location on the outer surface of said receiving means away from said pocket.

6. A system according to claim 1 wherein said strip of adhesive material incorporates a coating of thermosensitive adhesive, and wherein each of said mouthpieces is in thermal contact with said drum for receipt of heat for activating said adhesive.

7. A system according to claim 1 wherein each of said dispensers incorporates suction menas operative in synchronism with said vacuum menas for lifting an item dispensed by an individual dispenser from a supply of such items upon initiation of suction, and for release of such item to said receiving means upon termination of the suction by said suction means.

8. A system according to claim 7 wherein said set of work stations includes a fourth station, there being a dispenser of further strips of adhesive material at said fourth station, said vacuum means being operative with respect to said fourth station for the transference of the further strips of material to said receiving means for subsequent transfer to the container; and wherein the dispenser at said first station includes a roll of said adhesive material and means for cutting said adhesive material of said roll into said strips.

9. A system according to claim 1 wherein said set of work stations includes a fourth station, there being a dispenser of further strips of adhesive material at said fourth station, said vacuum means being operative with respect to said fourth station for the transference of the further strips of material to said receiving means for subsequent transfer to the container; and wherein:

the dispenser at said fourth station comprises a hopper for storing precut strips of adhesive material and a transfer roller having suction holes in its outer surface coupled to said suction means for transferring the precut strips of material from said hopper to said receiving means.

10. A system for applying a label and literature to the exterior surface of a container comprising:

a drum rotatably mounted between a set of work stations, a first of said stations being a dispenser of strips of adhesive material for affixation to said container, and a second of said stations being a dispenser of literature packets, the adhesive material and the packets being applied to the container at a third of said stations;

receiving means carried by said drum past each of said work stations for receiving strips of the material and packets from said dispensers of the material and the packets, respectively, at said first and said second work stations, said receiving means employing suction for holding said material and said packets, said receiving means formed as a set of mouthpieces disposed along the periphery of said drum, said mouthpieces having suction holes;

means for conveying the container to said drum at said third work station for transfer of the adhesive material and the packets to the container; and vacuum means synchronized with rotation of said drum for initiating and terminating suction at said receiving means, a transfer of a strip of said material and of a packet from their respective dispensers to said receiving means occurring upon initiation of suction by said suction vacuum means to said receiving means, a transfer of a strip of said material and of a packet from said receiving means to a container occurring upon a termination of the suction to said receiving means by said vacuum means, said vacuum means including a valve plate operatively coupled with said drum for initiating and terminating vacuum to respective ones of said mouthpieces, and said valve plate including an insert having vacuum supply channels therein for selectively presetting the duration of suction applied to the suction holes in said mouthpieces.

11. A system according to claim 10 wherein said insert is stationary.

* * * * *